United States Patent [19]

Ammann

[11] Patent Number: 4,524,727

[45] Date of Patent: Jun. 25, 1985

[54] HEAT EXCHANGER

[75] Inventor: Heinz Ammann, Winterthur, Switzerland

[73] Assignee: Sulzer Brothers Limited, Winterthur, Switzerland

[21] Appl. No.: 636,270

[22] Filed: Jul. 31, 1984

[30] Foreign Application Priority Data

Aug. 5, 1983 [CH] Switzerland ..... 4256/83

[51] Int. Cl.[3] ..... F22B 27/04

[52] U.S. Cl. ..... 122/235 A; 122/235 K; 122/6 A

[58] Field of Search ..... 122/235 A, 235 D, 235 K, 122/235 R, 510, 511, 6 A; 165/177

[56] References Cited

U.S. PATENT DOCUMENTS

| | | | |
|---|---|---|---|
| 2,723,650 | 11/1955 | Beute et al. | 122/235 R |
| 3,030,937 | 4/1962 | Witzke | 122/235 A |
| 3,117,558 | 1/1964 | Evans et al. | 122/235 A X |
| 4,075,979 | 2/1978 | Milhel | 122/235 A |
| 4,145,996 | 3/1979 | Brandes | 122/6 A |
| 4,245,588 | 1/1981 | Gill et al. | 122/6 A |
| 4,394,849 | 7/1983 | Pratt | 122/235 K |

*Primary Examiner*—Edward G. Favors
*Attorney, Agent, or Firm*—Kenyon & Kenyon

[57] ABSTRACT

The medium-carrying tubes of the vertical gas flue are bent outwardly of the boundary walls at the transverse gas flue and extend upwardly through the transverse gas flue in parallel groups. The medium-carrying tubes of the transverse gas flue are bent at the branch-off points of the vertical gas flue to fill the space in the planes of the vertical boundary walls left by the bent out tubes of the vertical flue and extend horizontally to common headers. The medium-carrying tubes of the vertical flue which pass through the transverse flue permit a uniform distribution of the temperature of the medium to be obtained at the outlet ends of the tubes.

8 Claims, 6 Drawing Figures

HEAT EXCHANGER

This invention relates to a heat exchanger. More particularly, this invention relates to a steam generator having a vertical gas flue and at least one transverse gas flue.

As is known, heat exchangers such as steam generators have been constructed in various forms. In one known type, the steam generator has been constructed with a vertical gas flue and at least one transverse gas flue which branches from the vertical gas flue. Generally, both flues have boundary walls which consist of medium-carrying tubes which are welded together in a gas tight manner with the tubes extending in the longitudinal direction of the respective flues. In addition, some of the wall tubes of the vertical gas flue have been used as support tubes and have been connected at the upper ends to a support scaffolding. Usually, the tubes of the transverse flue have been bent outwardly from the wall planes at the places where the transverse flue branches off from the vertical flue and have been directed into common headers.

In the known heat exchangers of the above type, particularly steam generators, the wall tubing in the vertical gas flue remains independent of that of the transverse gas flue. In such cases, the flues are interconnected in a gas-tight manner by means of a welded-in metal strip at the places where the walls of the two flues meet. In addition, the wall tubes of the vertical gas flue have been bent outwardly at these points and fed to separate headers with only the support tubes of the vertical gas flue extending through the opening at the place where the transverse flue branches off. These support tubes are also continued to suspension points at the uppermost zone of the vertical gas flue.

However, the above type of construction has a number of disadvantages. Specifically, the interruption of the wall tubes of the vertical gas flue in the region of the point where the transverse flue branches off and the running of the tubes to headers renders the construction complex and expensive. Further, this construction is also thermodynamically bad because some of the wall tubes of the vertical gas flue are excluded from the heat transfer process with the gas flowing in the two flues. There is therefore an uneven distribution of the heat absorption in the medium flowing through the tubes. As a result, the medium emerging from the bent wall tubes and the continuous wall tubes of the vertical gas flue has different temperatures. A thorough mixing in order to even out the temperature differences can be carried out only by means of special steps which are, in some cases, expensive.

Further, connecting the two flues by means of a welded-in metal strip results in difficult structural problems. Specifically, a connection of this kind is difficult to control with respect to the strength of the connection. This is because each of the two flues is subjected to different loads and because they are subjected to different thermal expansions. Further, stresses similar to notch effects may occur in the region of the connection.

Accordingly, it is an object of the invention to provide a heat exchanger having vertical and transverse gas flues which is of simple construction.

It is another object of the invention to simplify the connection of a transverse gas flue to a vertical gas flue.

It is another object of the invention to control the strength of a connection between a vertical gas flue and a branching-off transverse gas flue of a heat exchanger.

It is another object of the invention to obtain a uniform distribution of the heat absorption of a medium flowing through the tubes of a vertical gas flue which has a transverse gas flue branching therefrom.

Briefly, the invention provides a heat exchanger which is constructed of a vertical gas flue having a plurality of boundary walls and at least one transverse gas flue which branches from the vertical gas flue and which also has a plurality of boundary walls.

The boundary walls of the vertical gas flue each include a plurality of support tubes and medium-carrying tubes which are disposed in welded-together gas-tight relation. The boundary walls of the transverse gas flue each include a plurality of medium-carrying tubes which are disposed in welded-together gas-tight relation. In addition, the heat exchanger has a plurality of headers, each of which is connected in common to the tubes of a respective transverse gas flue wall.

In accordance with the invention, the medium-carrying tubes of the vertical flue at a branch-off point of the transverse gas flue are bent outwardly from the vertical flue as well as from the transverse gas flue in groups. In addition, each tube group extends to a common vertical plane which extends parallel to a longitudinal axis of the transverse gas flue. The tube groups then pass upwardly through the respective walls of the transverse gas flue in the common vertical plane and are thereafter bent in similar manner back into the walls of the vertical flue. The tubes of each group are also welded in gas-tight relation to the respective walls of the transverse gas flue.

In addition, at least some of the tubes of the transverse gas flue are bent at the vertical gas flue in order to fill a space in the vertical gas flue between the transverse flue and the branch off point of the bent tubes of the vertical gas flue.

As a result of this construction, the tubes which are bent out of the walls of the vertical gas flue extend through the interior of the transverse flue and can now lead into the same header as the other wall tubes of the vertical gas flue. Consequently, all the wall tubes of the vertical gas flue are of substantially equal length and are subjected equally to the gas flow. Hence, the temperatures of the medium emerging from these tubes are rendered uniform.

The transition from the vertical gas flue to the transverse gas flue is also improved structurally in that a seamless connection is formed between the walls of the two flues. In this respect, by bending over some of the wall tubes of the transverse flue, these bent portions become a part of the wall of the vertical gas flue. This provides a significant improvement to the strength of the connection between the two gas flues.

An additional advantage of the construction is that the connection between the flues has good bending flexibility. Hence, deformation due, for example, to different thermal expansion of the flues or earthquakes can be compensated for without difficulty.

A further advantage is that the construction can be applied to gas flues of all possible shapes, such as gas flues of polygonal or cylindrical cross section. The construction also allows perfect connections between gas flues of different cross-sectional shapes.

The heat exchanger may also be constructed so that the tube groups in a respective vertical plane passing through the transverse flue are aligned with a respective support tube of the vertical flue. In this case, the flow resistance of the gas at the transition from the vertical flue to the transverse flue is reduced.

In order to avoid thermal stresses and to provide a readily supervised tube run, the medium-carrying tubes at the branch-off point can be alternately disposed at at least two vertical levels while extending horizontally to a respective vertical plane. In this case, the bent tubes of the transverse flue extend horizontally to a respective header.

The tube groups which extend vertically through the transverse flue may have an equal number of tubes extending to each group from opposite sides of the common vertical plane in order to simplify the construction of the heat exchanger.

In order to provide a very simple construction at the passage points of the tube groups through the walls of the transverse flue, each transverse flue wall includes webs which are welded in between the tubes of the walls while the vertically disposed tubes from the vertical flue pass through a respective web.

The tubes of a respective wall of the transverse gas flue may also be bent about the vertical tube groups while being disposed in a common plane.

The medium-carrying tubes of the vertical flue and the transverse flue are made of the same outside diameter with each bent tube of the transverse flue being vertically aligned with a longitudinal axis of a tube of a respective tube group in the plane of a respective wall of the vertical flue. This provides a very good and readily supervised connection between the transverse flue walls and the vertical flue walls.

These and other objects and advantages of the invention will become more apparent from the following detailed description taken in conjunction with the accompanying drawings wherein.

Figure 4:
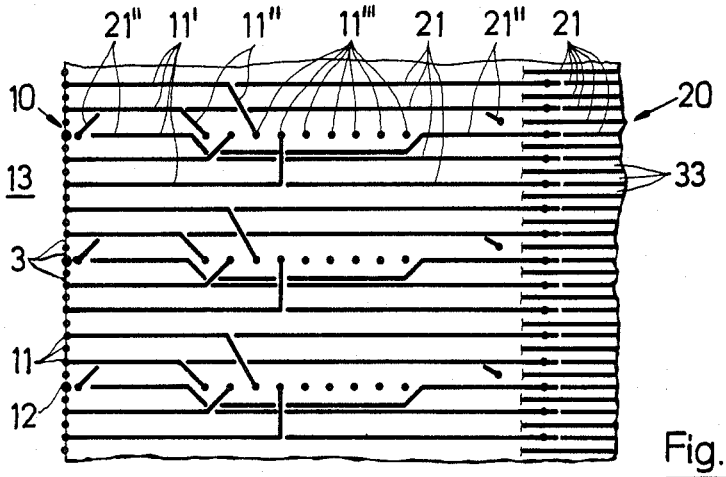
Figure 3:
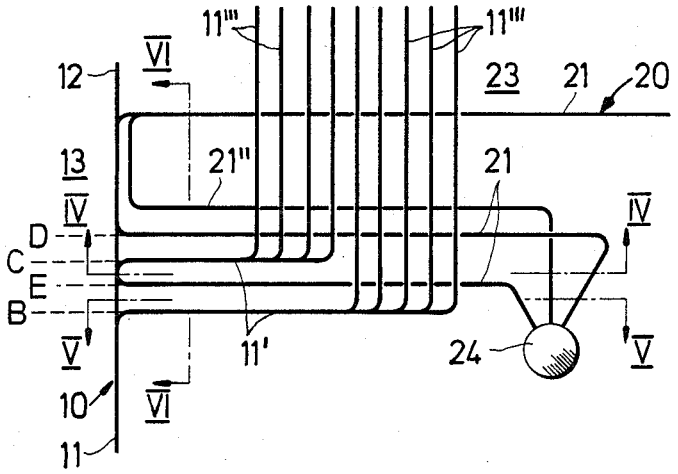
Figure 5:
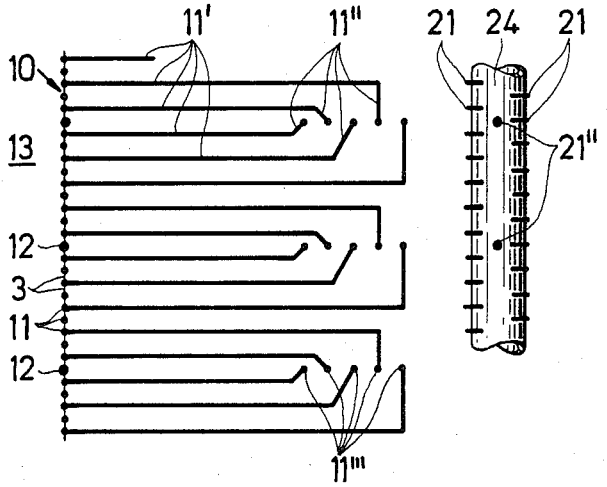

FIG. 3 schematically illustrates a modified connection between the tubes of a transverse gas flue and a vertical gas flue in accordance with the invention;

FIG. 4 illustrates a view taken on line IV—IV of FIG. 3;

FIG. 5 illustrates a view taken on line V—V of FIG. 3; and

Figure 6:
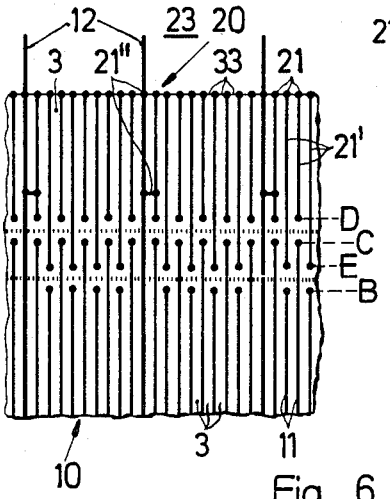

FIG. 6 illustrates a view taken on line VI—VI of FIG. 3.

Figure 1:
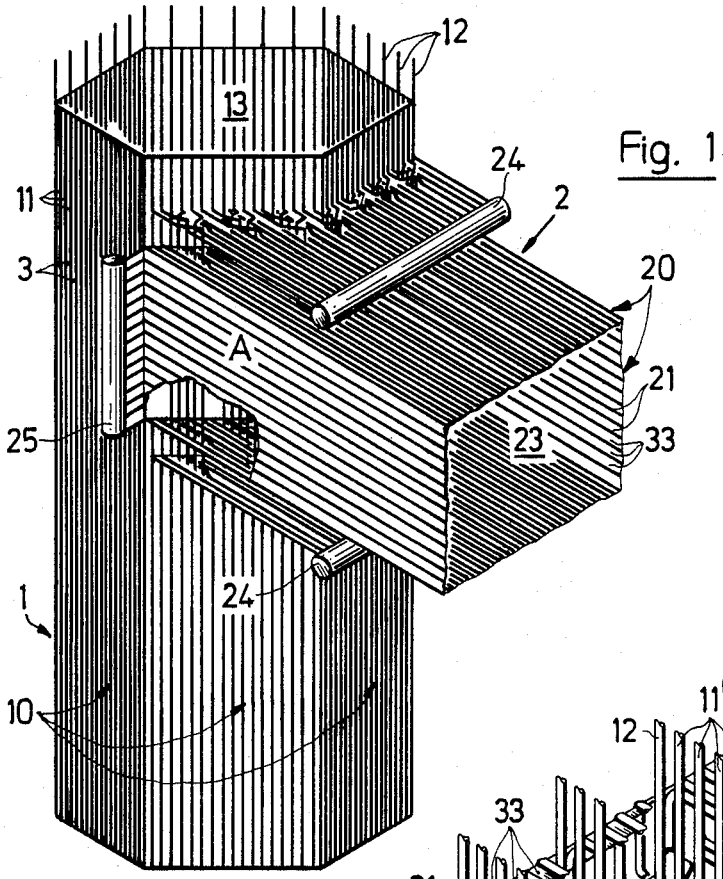
FIG. 1 illustrates a perspective view of a heat exchanger constructed in accordance with the invention.

Referring to FIG. 1, the heat exchanger, for example for a steam generator, has a vertical gas flue 1 of hexagonal cross-section and a transverse gas flue 2 of rectangular cross-section which branches from the vertical gas flue 1 near the top end of the gas flue 1. The two flues 1, 2 define spaces 13, 23 respectively for the flow, for example, of a hot gas. The vertical gas flue 1 has boundary walls 10 which consist of vertical medium-carrying wall tubes 11 welded together to be gas-tight by means of webs 3. Support tubes 12, which may have the same diameter as the wall tubes 11, replace the latter with regular spacing over the periphery of the gas flue 1. In order to distinguish the support tubes 12 from the wall tubes 11, the support tubes 12 are shown thicker than the wall tubes 11 in FIG. 2. The vertical gas flue 1 is suspended from a support scaffold (not shown) by means of the support tubes 12.

Figure 2:
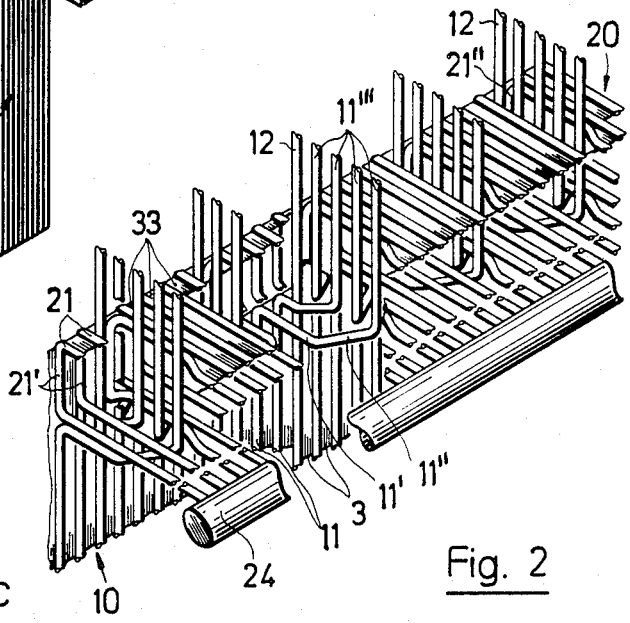
FIG. 2 illustrates a perspective view of a detail of the connection of the transverse gas flue to the vertical gas flue of FIG. 1 at the area marked "A" in FIG. 1.

In the region of the place where the transverse flue 2 branches off, the support tubes 12 pass through the opening joining the spaces 13, 23 whereas the wall tubes 11 are bent out of the wall 10 just before the intersection with the transverse flue 2 and initially along a short horizontal section to extend parallel to the longitudinal axis of the transverse flue 2 (portion 11′ in FIG. 2). The short distances are different for the individual tubes. The tubes are then bent horizontally again (portion 11″ in FIG. 2) and taken as far as a common vertical plane, each such plane containing the longitudinal axis of a support tube 12 passing through the transverse flue 2, and extending parallel to the longitudinal axis of the transverse flue. Aproximately half the wall tubes 11 situated on either side of a support tube 12 of this kind are combined in the form of a group in the vertical plane in alignment with the associated support tube 12. Where the portions 11″ of the tubes 11 reach the vertical plane they are equi-spaced from one another. At this place, the wall tubes 11 are then bent up so that from then on they extend vertically in parallel relationship to the associated support tube 12 and with their longitudinal axis in the vertical plane (portion 11‴ in FIG. 2). The configuration of the tubes 11 thus far described with respect to the bottom of the transverse flue 2 applies in reversely identical manner to the configuration of the tubes 11 on the top of the transverse flue.

The four walls 20 defining the transverse flue 2 consist of wall tubes 21 having the same diameter as the wall tubes 11 and are also welded together to be gas-tight by means of webs 33. The wall tubes 21 extend parallel to the longitudinal axis of the transverse flue 2. Where they meet the walls 10 of the vertical gas flue 1, the wall tubes 21 of the two vertical walls 20 are bent outwards horizontally and lead into a vertical header 25 at each wall. At the place where the tubes 21 of the vertical walls 20 are bent, they are welded to the associated wall 10 so as to be gas-tight.

The wall tubes 21 of the two horizontal walls 20 are so bent where they meet the walls 10 of the vertical gas flue 1 as to continue vertically in the associated wall 10 form this bend (portion 21′) to close to the place where the tube 11 in alignment therewith in the wall 10 is bent.

The webs 33 of the two horizontal walls 20 are also continued seamlessly in the vertical walls 10 of the gas flue 1, with the same web width in that wall 10 whose plane forms a right angle with the longitudinal axes of the wall tubes 21, and with a narrower width in the two walls 10 whose plane forms an angle other than 90° with the longitudinal axes of the wall tube 21 meeting the same. The webs 33 from the horizontal walls 20 are welded in gas-tight relationship to the webs 3 from the walls 10 at the place where the tubes 11 are bent. At a distance of about half the web width from the place where the tubes 11 are bent, the vertical portions 21′ of the wall tubes 21 are bent outwards and are taken to a top and bottom horizontal header 24 parallel to the portions 11′ of the wall tubes 11. The portions 21′ with the webs 33 between them thus fill that part of the walls 10 which are situated between the places where the tubes 11 are bent and the branch-off point of the transverse flue 2. This construction of the transition between the gas flue 1 and the transverse flue 2 gives an excellent strength connection between the walls 10 and the horizontal walls 20.

The vertical portions 11‴ of the wall tubes 11 of the vertical gas flue 1 pass through the two horizontal walls 20 of the transverse flue 2, the places where a group thus passes through each being situated in a web 33 between two wall tubes 21. At the passage places, the portions 11''' are welded to the webs 33 so as to be gas-tight. Since the portions 11''' are in alignment with the associated support tube 12, they would meet a tube 21 in the horizontal wall 20 given a rectilinear path. To avoid this, each wall tube 21 leading to a support tube 12 is taken around the passage places of the portions 11'''. These tubes, one of which is shown on the right in FIG. 2 at reference 21'', are also bent out of the horizontal wall 20 before meeting the associated support tubes 12—i.e., outside the vertical gas flue 1—and taken parallel to the support tube 12 to their next bend. On their path to the header 24, the tubes 21'' are again taken around the vertical portions 11'''.

The flow of the gas impinging on the gas flues 1 and 2 is practically undisturbed irrespective of its direction of flow. Since all the tubes extending through the space 23 are disposed consecutively in the direction of flow, the disturbance they cause to the gas flow is substantially identical to the disturbance that the support tubes 12 would cause in any case and which, of course, is negligible. The distance over which the wall tubes 11 are taken outside the gas flues and over which they do not participate in the heat exchange with the flowing gas is compensated for by fully immersing these tubes in the gas flow on their passage through the transverse flue 2 so that their entire periphery takes part in the heat exchange, instead of just a part of the periphery as is the case with the flow in the walls 10.

Referring to FIGS. 3–6, the wall tubes 11 of the vertical gas flue on either side of the branch-off point of the transverse flue 2 are bent alternately at two different vertical planes—B and C in FIGS. 3 and 6. The portions 21' of the wall tubes 21 of the two horizontal walls 20 of the transverse flue 2 are also bent out of the walls 10 of the vertical gas flue alternately on either side of the branch-off point at two different vertical planes—D and E in FIGS. 3 and 6.

FIG. 4 is a clearer view than FIG. 2 showing how the wall tubes 21'' which converge on a support tube 12 are taken around the portions 11''' where they pass through. The tubes 21'' are taken to the header 24 outside the planes D and E. The embodiment shown in FIGS. 3—6 avoids excessively large web surfaces and hence the incidence of high thermal stresses.

Departing from the exemplified embodiments described, the top horizontal wall 20 of the transverse flue 2 can be continued rectilinearly, instead of being bent upwards, to form the top end of the vertical gas flue 1. In that case, the vertical portions 11''' of the wall tubes 11 are not taken back to the wall 10 of the vertical gas flue 1 after leaving the transverse flue 2, but are taken directly to a header (not shown) to which the other wall tubes 11 not taken through the transverse flue can also lead.

The bracing for the transverse flue 2 is not illustrated but is provided, for example, by support frames secured to a support scaffolding.

Departing from the embodiment shown in FIG. 1, both vertical walls 20 of the transverse flue can be provided with tubes which extend transverse to the longitudinal direction.

The invention thus provides a heat exchanger having a simplified connection between a vertical gas flue and a transverse gas flue which branches from the vertical gas flue. In addition, the connection permits the medium-carrying tubes of the vertical flue to provide for a uniform distribution of the heat absorption of the tubes.

The invention further provides a relatively simple connection between a vertical gas flue and a transverse gas flue which can be readily inspected and maintained.

What is claimed is:

1. A heat exchanger comprising a vertical gas flue having a plurality of boundary walls, each said wall including a plurality of support tubes and medium-carrying tubes disposed in welded-together gas-tight relation;

at least one transverse gas flue branching from said vertical gas flue and having a plurality of boundary walls, each said wall of said transverse gas flue including a plurality of medium-carrying tubes disposed in welded-together gas-tight relation;

a plurality of headers, each said header being connected in common to said tubes of a respective transverse gas flue wall;

said medium carrying tubes of said vertical flue at a branch-off point of said transverse gas flue being bent outwardly from said vertical flue and said transverse gas flue in groups, each said group extending to a common vertical plane extending parallel to a longitudinal axis of said transverse gas flue and passing upwardly through respective walls of said transverse gas flue in said common vertical plane, said tubes of each group being welded in gas-tight relation to said respective walls of said transverse gas flue; and at least some of said tubes of said transverse gas flue being bent at said vertical gas flue to fill a space in said vertical gas flue between said transverse gas flue and said branch-off point of said bent tubes of said vertical gas flue.

2. A heat exchanger as set forth in claim 1 wherein each vertical plane is aligned with a respective support tube.

3. A heat exchanger as set forth in claim 1 wherein said tubes in each vertical plane are vertical.

4. A heat exchanger as set forth in claim 1 wherein said medium-carrying tubes at said branch-off point are alternately disposed at at least two vertical levels and extend horizontally to a respective vertical plane and wherein said bent tubes of said transverse gas flue extend horizontally to a respective header.

5. A heat exchanger as set forth in claim 1 wherein an equal number of tubes extends to a respective tube group from opposite sides of said common vertical plane.

6. A heat exchanger as set forth in claim 1 wherein each wall of said transverse gas flue includes webs welded in-between said tubes thereof and wherein said tubes in each vertical plane passes through a respective web.

7. A heat exchanger as set forth in claim 1 wherein said tubes of a respective wall of said transverse gas flue through which said tube groups pass are bent about said tube groups and are disposed in a common plane.

8. A heat exchanger as set forth in claim 1 wherein said medium-carrying tubes of said vertical gas flue and said transverse gas flue are of the same outside diameter with each said bent tube of said transverse gas flue being vertically aligned with a longitudinal axis of a tube of a respective tube group in the plane of a respective wall of said vertical gas flue.

* * * * *